US006572228B2

(12) United States Patent
Kaga et al.

(10) Patent No.: US 6,572,228 B2
(45) Date of Patent: Jun. 3, 2003

(54) IMAGE FORMING METHOD

(75) Inventors: Makoto Kaga, Hino (JP); Atsushi Tomotake, Hino (JP); Shuji Kida, Hino (JP); Shinichi Suzuki, Hino (JP); Masaki Nakamura, Hino (JP); Hidenobu Ohya, Hino (JP)

(73) Assignee: Konica Corporation, Tokyo (JP)

( * ) Notice: Subject to any disclaimer, the term of this patent is extended or adjusted under 35 U.S.C. 154(b) by 30 days.

(21) Appl. No.: 09/870,908

(22) Filed: May 31, 2001

(65) Prior Publication Data

US 2002/0008747 A1 Jan. 24, 2002

(30) Foreign Application Priority Data

Jun. 1, 2000 (JP) ..... 2000-164386

(51) Int. Cl.[7] ..... B41J 2/01; B41J 3/407
(52) U.S. Cl. ..... 347/102; 347/106
(58) Field of Search ..... 347/100, 101–103, 347/104–106, 96

(56) References Cited

U.S. PATENT DOCUMENTS 5,471,233 A * 11/1995 Okamoto et al. ..... 347/103
5,716,435 A * 2/1998 Aida et al. ..... 106/31.85
5,886,727 A * 3/1999 Dobashi et al. ..... 347/213
6,322,679 B1 * 12/2001 Higuma et al. ..... 347/102

FOREIGN PATENT DOCUMENTS

| | | |
|---|---|---|
| EP | 0 233 039 | 8/1987 |
| EP | 0 671 268 A1 | 9/1995 |
| JP | 2-31673 | 7/1990 |
| JP | 6-145570 | 5/1994 |
| JP | 6-171072 | 6/1994 |
| JP | 10-291306 | 11/1998 |
| JP | 11-208097 | 8/1999 |
| JP | 2000-15927 A | 1/2000 |

* cited by examiner

*Primary Examiner*—John Barlow
*Assistant Examiner*—An H. Do
(74) *Attorney, Agent, or Firm*—Frishauf, Holtz, Goodman & Chick, P.C.

(57) ABSTRACT

An image forming method using an ink jet is disclosed. A pigment ink containing a dispersed pigment is jetted onto an ink jet recording medium. The recording medium support having as the outermost layer an ink receptive layer comprising thermoplastic resinous particles and a pigment ink solvent absorptive layer adjacent to said ink receptive layer. The fine thermoplastic particle ink receptive layer is the outermost layer onto which the ink is jetted. Thereafter, the outermost layer containing the jetted ink is transparentized by simultaneous application of heat and pressure to obtain an image.

23 Claims, 1 Drawing Sheet

IMAGE FORMING METHOD

FIELD OF THE INVENTION

The present invention relates to an image forming method which comprises carrying out recording an image on an ink recording medium having a thermoplastic resinous layer on a support utilizing a pigment ink, and then at least heating the ink recording medium.

BACKGROUND OF THE INVENTION

Ink jet recording is carried out in such a manner that minute ink droplets are allowed to jet utilizing various working principles, and to adhere onto a recording medium so that images and texts are recorded. Ink jet recording exhibits advantages of relatively high speed, low noise and the ease of multicolor formation.

Further, as a result of technical progress in recent years, the image quality of ink jet prints prepared by utilizing a dye ink have approached those prepared utilizing silver halide photography, and further, the price of such units has been reduced. As a result, ink jet printing has been increasingly employed.

Generally, dyes are soluble in solvents, and dye molecules are subjected to dying in either a molecular state or a cluster state. Accordingly, each dye molecule exists in a similar environment. Thus its absorption spectra have a narrow band and the resultant color is very pure as well as clear. In addition, since dyes exhibit no particle properties, neither light scattering nor light reflection occurs, resulting in high transparency as well as clear hue.

By contrast, however, when dye molecules are decomposed due to photochemical reactions and the like, the number of dye molecules decreases. Since the color density is proportional to the number of dye molecules, a decrease in the number of dye molecules results in degradation of light fastness. Ink jet recorded images utilizing a dye ink result in high image quality. However, the image quality markedly degrades during storage. Accordingly, the present situation is such that, in terms of image retention quality, no ink jet technique has yet developed which exceeds silver halide photography in that regard.

While competing with dye inks, employed as inks which are used to prepare images which results in desired light fastness are pigment inks in which pigments, which results in good light fastness, are employed as the colorant. Pigments are generally insoluble in solvents, and dye molecules form particles which result in color formation in a state dispersed in solvents. Even though molecules on the particle surface are subjected to decomposition due to photochemical reaction and the like, under the surface are dye molecule layers. As a result, apparent color results in minimum change so as to obtain good image retention quality. However, glossiness markedly degrades due to effects of scattered light, as well as due to reflected light of dye particles.

However, in images prepared by employing said pigment ink, since pigment particles are attached onto the medium surface, image quality results in degradation such as formation of bronzing, a decrease in glossiness, and the like. As a result, the quality of obtained images was inferior to that of conventional photography. In order to overcome the aforementioned problems, for example, methods in which latexes are incorporated into the ink are disclosed in Japanese Patent Publication Open to Public Inspection Nos. 6-145570 and 6-171072. The image quality obtained employing said method is improved compared to conventional one. However, glossiness as well as image quality has not reached a sufficient level, and specifically, bronzing in high density areas remains a major problem. Further, Japanese Patent Publication Open to Public Inspection No. 11-208097 discloses a technique in which, after a recording medium comprising a thermoplastic resinous layer as the outermost layer is recorded employing a pigment ink which does not comprise dispersing agents, pigment particles migrate into said thermoplastic resinous layer. In said patent, specifically disclosed as a method to facilitate migration of pigment particles adhered on the exterior surface of said thermoplastic resinous layer into said thermoplastic resinous layer is a method in which heating is carried out for 20 minutes while maintaining a temperature in the range of from 110 to 140° C. When only such a heating treatment is carried out, said thermoplastic resin is fused, but the migration of pigment particles into said resin is not sufficiently accomplished and the surface is not sufficiently smoothed. Accordingly, resulting prints exhibit insufficient abrasion resistance as well as insufficient glossiness. In order to obtain sufficient abrasion resistance as well as sufficient glossiness, employing a pigment ink and media comprising said thermoplastic resinous layer, it is important that in the treatment after printing, pigment particles are sufficiently buried into the resinous layer.

Japanese Patent Publication No. 2-31673 discloses a technique regarding a recording medium resulting in excellent water resistance as well as excellent light fastness, which is comprised of a thermoplastic resinous layer as the outermost layer and an inorganic pigment layer as the adjacent layer. Even though the image durability is definitely improved employing the layer configuration in accordance with the aforementioned patent, no disclosure at all is made regarding ink jet recorded images produced by employing pigment ink, and no suggestion is made regarding the improvement of image performance which is obtained by application of not only heat but also pressure after recording, using an ink jet method.

SUMMARY OF THE INVENTION

An object of the present invention is to provide an image forming method employing a pigment ink capable of improving glossiness, abrasion resistance, and releasability during ink jet recording.

The aforementioned object of the present invention is accomplished employing embodiments described hereunder.

(1) An image forming method comprising jetting a pigment ink onto the ink jet recording medium comprising a support, and provided thereon, an ink receptive layer comprising thermoplastic resinous particles farthest from the support, by means of an ink jet method, applying heat and pressure simultaneously to the ink jet recording medium having the jetted ink.

(2) The image forming method of item 1 wherein the ink jet recording medium comprises a pigment ink solvent absorptive layer adjacent to said ink receptive layer.

(3) The image forming method of item 2 wherein the pigment ink comprises a dispersing agent.

(4) The image forming method of item 1, wherein heat and pressure is applied employing a heating roller.

(5) The image forming method of item 4, wherein the heating roller comprises a metallic cylinder and a silicone rubber roller.

(6) The image forming method of item 5, wherein the metallic cylinder contain a heating source inside of the metallic cylinder.

(7) The image forming method 4, wherein a nip width, formed by pressure between said metallic cylinder and said silicone rubber roller, is from 1 to 20 mm.

(8) The image forming method of item 1, wherein heating temperature of the ink jet recording medium is from 50 to 150° C.

(9) The image forming method of item 4, wherein linear pressure resulted by said heating roller is from 500 to 3,000 N/m.

(10) The image forming method of item 1, wherein the thermoplastic resinous layer comprises a silicone emulsion in an amount of 0.5 to 10 percent by weight in terms of solid, or a water-soluble silicone compound in an amount of 0.5 to 10 percent by weight, with respect to the thermoplastic resinous particles.

(11) The image forming method of item 1 wherein glass transition point, Tg, of said thermoplastic resinous layer is higher than temperature at which said thermoplastic resinous particles are coated and dried during the production of said ink jet recording material, and is lower than the temperature at which said support is subjected to thermal modification due to said heating.

(12) The image forming method of item 2 wherein void volume of the ink receiving layer and the pigment ink solvent-absorbing layer is from 20 to 40 ml/m$^2$.1. An image forming method wherein, after a pigment ink, comprising a dispersing agent, is adhered employing an ink jet method onto an ink jet recording medium comprising a support having as the outermost layer an ink receptive layer comprising thermoplastic resinous particles and a pigment ink solvent absorptive layer adjacent to said ink receptive layer, said fine thermoplastic particle ink receptive layer as the outermost layer is transparentized by a simultaneous application of heat and pressure to obtain an image.

The other embodiments of the invention are described.

1. An image forming method wherein, after a pigment ink, comprising a dispersing agent, is adhered employing an ink jet method onto an ink jet recording medium comprising a support having as the outermost layer an ink receptive layer comprising thermoplastic resinous particles and a pigment ink solvent absorptive layer adjacent to said ink receptive layer, said fine thermoplastic particle ink receptive layer as the outermost layer is transparentized by a simultaneous application of heat and pressure to obtain an image.

2. The image forming method described in 1. above wherein heat as well as pressure is applied employing a heating roller.

3. The image forming method described in 1. or 2. above wherein said heating roller is comprised of a metallic cylinder as well as a silicone rubber roller.

4. The image forming method described in any one of 1. through 3. above wherein a heating source is built into said metallic cylinder.

5. The image forming method described in any one of 1. through 4. above wherein a nip width, formed by pressure between said metallic cylinder and said silicone rubber roller, is from 1 to 20 mm.

6. The image forming method described in any one of 1. through 5. above wherein heating temperature resulting from said heating source, which is built into said metallic cylinder, is from 50 to 150° C.

7. The image forming method described in any one of 1. through 6. above wherein linear pressure resulted by said heating roller is from $9.8\times10^4$ to $4.9\times10^6$ Pa.

8. The image forming method described in any one of 1. through 7. above wherein either a silicone emulsion or a water-soluble silicone compound is incorporated into said thermoplastic resinous layer in an amount of less than 1 percent by weight, with respect to the thermoplastic resinous particles.

9. In an image forming method in which after adhering ink onto an ink jet recording medium comprising a support having thereon a layer comprising thermoplastic resinous particles, employing an ink jet method, heating is carried out, an image forming method wherein the glass transition point, Tg, of said thermoplastic resinous layer is higher than the temperature at which said thermoplastic resinous particles are coated and dried during the production of said ink jet recording material, and is lower than the temperature at which said support is subjected to thermal modification due to said heating.

10. In an image forming method in which after adhering ink onto an ink jet recording medium comprising a support having thereon an ink receiving layer comprising thermoplastic resinous particles as well as a pigment ink solvent absorbing layer, heating is carried out, an image forming method wherein the void volume of said ink receiving layer as well as said pigment ink solvent-absorbing layer is from 20 to 40 ml/m$^2$.

DETAILED DESCRIPTION OF THE INVENTION

Figure 1:
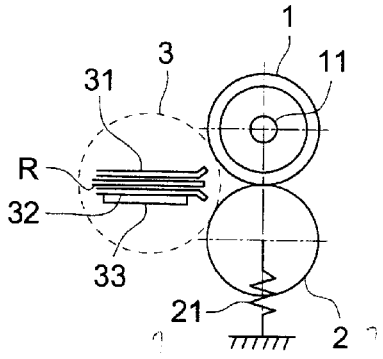
FIGS. 1, 2 and 3 each show a schematic view of heating means employing for heating the recording medium.

The inventor of the present invention discovered the following. It was found that abrasion resistance was degraded in case that the surface of a thermoplastic resinous particle-containing ink layer was subjected to ink jet recording, employing a pigment ink comprising dispersing agents, only when heating was carried out. Said degradation was assumed to be due to insufficient inclusion of pigment particles into said resinous layer. On the other hand, in case that the ink jet recording was carried out employing a self-diffusible pigment ink, heating was carried out, and abrasion resistance was evaluated in the same manner, the improvement effects were found, but the resultant effects were insufficient. In addition, contrary to the inventors' expectations, the glossiness was found to be degraded compared to the dispersing agent containing ink.

On the other hand, it was discovered that the resultant abrasion resistance was improved in case that the ink jet recording was carried out employing a dispersing agent containing pigment ink, and afterwards, heat and pressure were simultaneously applied. It was assumed that by simultaneously applying heat and pressure, pigment particles are sufficiently buried into the thermoplastic resinous particle layer (hereinafter referred simply to as thermoplastic resin), and by providing a dispersing agent between pigment particles, aggregation of pigment particles, after being adhered onto the surface of the recording material, was minimized so that it was possible to uniformly render energy, provided by an application of heat and pressure, the image surface.

Accordingly, the simultaneous application of heat and pressure, as described herein, means that during the application of pressure, heat energy should be applied. Thus, the application of heat may be carried out at the same time as that of pressure, or the application of heat may be carried out prior to that of pressure.

The present invention will now be detailed below.

The ink jet recording medium of the present invention is constituted so as to comprise a support having as the outermost layer an ink receptive layer comprising thermoplastic resinous particles, and preferably, further comprises a solvent absorptive layer having a void layer adjacent to a thermoplastic resinous layer into which ink solvent components are absorbed, after colorants and ink solvent components are separated on the surface of said ink receptive layer.

The present invention is characterized in that, after an ink receptive layer is subjected to ink jet recording, employing a pigment ink comprising dispersing agents, said ink receptive layer is subjected to a simultaneously application of heat and pressure, and transparentized to obtain images.

Due to that, it is possible to transparentize the ink receiving layer and to improve the image quality. The transparentizing ink receiving layer as described in the present invention refers to a process in which the transparency of the ink receiving layer is improved. A degree of transparency is not particularly limited. The high degree of transparency is more preferred so that images are not degraded due to the color of the ink receiving layer. It is possible to transparentize the image receiving layer by an application heat and/or pressure after ink jet recording. By applying heat/or pressure, the surface is smoothed in such as manner that thermoplastic resinous particles are fused with each other and are buried into the resin. As a result, transparency is improved due to the fact that irregular reflection on the surface of pigment particles, as well as of thermoplastic resinous particles, is minimized, and the like.

Thermoplastic resinous particles are comprised, for example, of polycarbonate, polyacrylonitrile, polystyrene, polyacrylic acid, polymethacrylic acid, polyvinyl chloride, polyvinylidene chloride, polyvinyl acetate, polyester, polyamide, polyether, and copolymers and salts thereof. When said thermoplastic resinous particles are selected, it is essential to take into account ink receptivity, image glossiness after fixing under an application of heat as well as an application of pressure, image durability, and releasability.

When the diameter of said thermoplastic resin particles is not less than 0.01 $\mu$m, the rate of the separation of pigment particles from the ink solvents is increased. As a result, regarding the ink receptivity, the ink absorbing rate is also increased. Furthermore, from the point of the adhesive properties of the solvent absorptive layer adjacent to the ink receptive layer during coating onto the support, as well as of the layer strength of the ink jet recording media, diameters of not more than 10 $\mu$m, are preferred. Accordingly, the diameter of the thermoplastic resinous particles is preferably from 0.01 to 10 $\mu$m, and is more preferably from 0.05 to 1 $\mu$m.

Thermoplastic resinous particles, which form the outermost layer, exist in solvents such as water and the like, in a dispersed state prior to coating and drying. Monodispersed thermoplastic resinous particles, having a uniform diameter of dispersed particles, are subjected to close hexagonal packing to form a monodispersed particle layer, in which the void ratio is 26 percent. Generally, however, the thermoplastic resinous particles are polydispersed and the resultant void ratio varies depending on the state formed by aggregating each of thermoplastic resinous particles. Further, the resultant void diameter depends on the diameter of said thermoplastic resinous particles.

Further, the coating thickness on the support is preferably from 0.1 to 20 $\mu$m, and is more preferably from 0.5 to 10 $\mu$m.

Further, listed as the standard for selecting thermoplastic resinous particle is the glass transition point (Tg).

When Tg is lower than the coating drying temperature, for example, the coating drying temperature during the production of a recoding medium, is higher than Tg, voids, which are formed by fine thermoplastic particles, disappear due to the penetration of ink solvents.

Further, when Tg is not lower than the temperature at which the support is subjected to modification due to heat, in order to carry out melt casting after ink jet recording employing a pigment ink, a fixing operation is needed at high temperature. As a result, load applied to the apparatus, heat stability, and the like become problematic. The Tg of thermoplastic resinous particles is preferably from 50 to 130° C.

Further, after forming images, it is necessary that, during storage, recorded images be degraded as little as possible. When pigment ink is employed, it is unnecessary to worry about a decrease in density as well as discoloration over a short period of time, which occurs when dye ink is employed. However, from the viewpoint of minimizing the yellowing (due to decomposition) of non-printed areas due to ultraviolet rays, it is necessary to select the thermoplastic resinous particles.

It is possible to utilize fine organic solid particles instead of fine inorganic solid particles. However, fine inorganic solid particles are more preferred due to the fact that a higher void volume is obtained.

When a pigment ink solvent absorptive layer (hereinafter occasionally referred simply to as an ink solvent absorptive layer) adjacent to the thermoplastic resinous layer as the outermost layer is provided, it is necessary that the ink solvent adsorptive layer exhibit pigment ink solvent absorbing capability. Although said capability is achieved by incorporating fine organic solid particles into said pigment ink solvent absorptive layer, the ink solvent absorption layer containing the inorganic particles exhibits more excellent solvent absorbing capacity than that containing organic particles.

Listed as fine inorganic particles which are employed to achieve the aforementioned objective are white inorganic pigments such as, for example, precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, false boehmite, aluminum hydroxide, lithopone, zeolite, magnesium hydroxide, and the like.

The average particle diameter of fine inorganic particles is obtained in such a manner that fine particles themselves, the cross-section of a void type ink solvent absorptive layer, or fine particles exposed onto the surface are observed employing an electron microscope, the diameter of randomly selected 100 particles are determined, and the simple average (number average) is obtained. The diameter of each particle as described herein refers to the diameter of the circle which has the same projection area as said particle.

From the viewpoint that high density images are formed, clear images can be recorded, and production can be carried out at low cost, it is preferred to employ fine inorganic solid particles which are selected from fine particles comprised of silica, which are synthesized employing a gas phase method, colloidal silica and alumina, or alumina hydrates.

Said alumina or alumina hydrates may be either crystalline or non-crystalline. Further, it is possible to employ those which have undefined shapes such indeterminate shape particles, spherical particles, needle-shaped particles, and the like.

Currently, such fine silica particles, which are synthesized employing a gas phase method, are commercially available. Commercially available fine silica particles include various types of Aerosil manufactured by Nippon Aerosil Co.

In order to obtain the effects of the present invention, the average diameter of fine inorganic particles is not particularly limited, but is preferably 1 to 100 nm. The most preferred average particle diameter to form a void layer varies depending on the used compounds. For example, in the case of said silica synthesized employing a gas phase method, fine inorganic particles, having an average primary particle diameter (particle diameter in the dispersed state prior to coating) of from 4 to 20 nm, which are dispersed in a primary particle state, may be most preferably employed.

Further, in order to prepare said ink solvent absorptive layer, employed may be, other than said fine inorganic particles, various types of aqueous resins and compounding compositions with silica described, for example, in Japanese Patent Publication Open to Public Inspection Nos. 59-148584, 55-51583, 58-72495, and others, and alkylene oxide- or polycarbonate-containing urethane resin emulsion described in Japanese Patent Publication Open to Public Inspection Nos. 9-150574, and 10-181189, and the like.

Further, other than the formation of the ink solvent absorptive layer employing said fine inorganic particles, said ink solvent absorptive layer may be formed employing a coating composition comprising polyurethane resin emulsions, together with water-soluble epoxy compounds and/or acetoacetylated polyvinyl alcohol, and further, together with epichlorohydrin polyamide resins.

In this case, preferred polyurethane resin emulsions are those having a particle diameter of 3.0 $\mu$m, and having a polycarbonate chain or a polycarbonate chain as well as a polyester chain. The polyurethane resins of said polyurethane resin emulsions comprises more preferably polyols having polycarbonate polyols or polycarbonate polyols as well as polyester polyols, polyurethane resins which have a sulfonic acid group in their molecule, in addition, epichlorohydrin polyamide resins, and water-soluble epoxy compounds and/or acetoacetylated vinyl alcohol.

It is assumed that in the ink solvent absorptive layer prepared by employing said polyurethane resins, a weak aggregation of cations and anions is formed, and as a result, voids which exhibit ink solvent absorbing capability are formed, which make it possible to form the desires images.

In the thermoplastic resinous layer as well as the solvent absorptive layer of the ink jet recording medium of the present invention, the total amount of voids (void volume) is preferably at least 20 ml per $m^2$ of the recording medium.

When the void volume is less than 20 ml/$m^2$, an ink amount of no more than 1 ml/$m^2$ results in excellent ink absorbability. However, when an ink amount is over 40 ml/$m^2$ ink absorption is insufficient and ink overflows, and therefore, problems in which image quality degradation such as mottle or bronzing tend to occur, the rate of drying is low, and the like.

The upper limit of said void volume is not particularly limited, but it is necessary that the layer thickness of a void type ink absorbing layer be commonly no more than 50 $\mu$m so that the degradation of physical characteristics of the layer such as cracking, and the like, is minimized. From this viewpoint, it is difficult to increase the void volume to at least 40 ml/$m^2$.

When a void volume is measured employing a liquid absorbability test method (Bristo method), said void volume is represented by a liquid transfer volume (ml/$m^2$) over 2 seconds of absorption time.

In the present invention, the void volume is expressed utilizing liquid transfer volume (in ml/$m^2$) for 2 seconds of absorption time, when determined employing Paper and Paper Board Liquid Absorbability Test Method (Bristo Method) of TAPPI Paper and Pulp Test Method No. 51-87. Further, in said test method, pure water (deionized water) is employed for said measurement. However, in order to easily discriminate measurement areas, water-soluble dyes may be incorporated into said water in an amount of less than 2 percent.

Employed as supports of the present invention may be those which have been conventionally employed as ink jet recording paper such as, for example, plain paper, art paper, coated paper, cast coated paper, and the like, plastic supports, paper supports laminated with polyolefin on both sides, and composite supports laminated with these.

During the coating of ink jet recording media of the present invention, in order to enhance coatability, thickeners may be employed. Coating methods include a bar coater, a roll coater, an applicator, a spinner, and the like. Other than these, from the viewpoint of the enhancement of production efficiency, when at least two layers are simultaneously coated, extrusion coating as well as curtain coating is particularly effective.

In response to purposes for enhancing various performance such as ejection stability, adaptability with print heads as well as ink cartridges, storage stability, image retention quality, and the like, further viscosity regulating agents, resisitivity regulating agents, film forming agents, UV absorbers, antioxidants, anti-fading agents, antirusting agents, antiseptics, and the like may be incorporated into the ink of the present invention.

Employed as methods for heating ink jet recording materials which are adhered to the pigment ink employed in the present invention may be a method utilizing heating rollers comprised of a pair of rollers in which at least one of said rollers comprises a heating source. From the point of simplifying the apparatus, it is preferable that heat, as well as, pressure is simultaneously applied to said materials employing said heating rollers. However, pressure applying rollers may be provided which apply pressure to the ink jet recording medium which has been heated by different heating rollers from said heating rollers.

Figure 2:
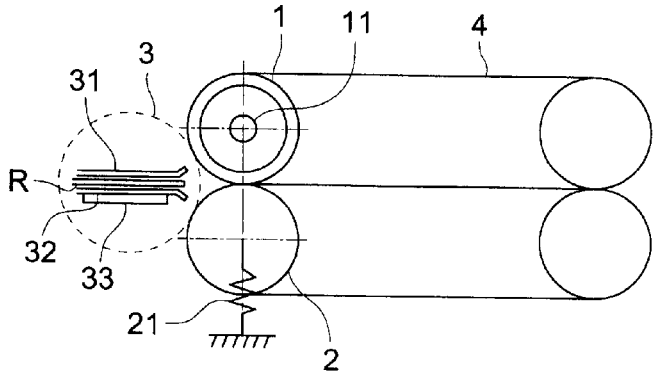
Figure 3:
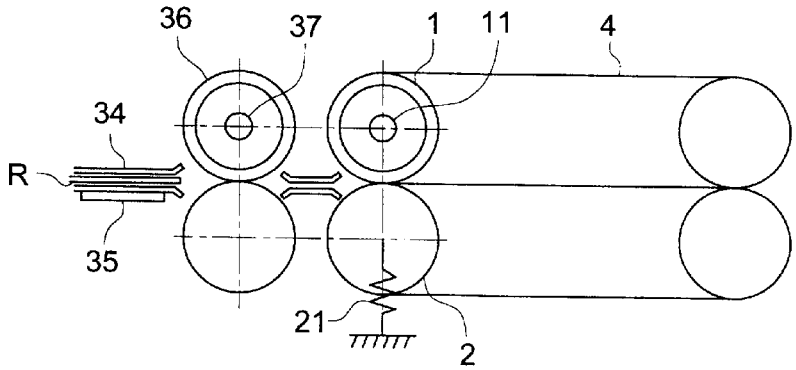

Rollers comprising a heating source preferably heat the surface of the ink jet recording material on which a pigment ink has been adhered so that the ink receiving layer is more efficiently transparentized and the support tends not to be modified even though subjected to a high heating temperature. In FIGS. 1, 2, and 3, recording medium R is subjected to application of heat and pressure while passing between heating roller 1 comprising built-in heater 11 and pressure applying roller 2 which is arranged to face said heating roller 1 and is subjected to application of pressure utilizing spring 21. Upstream of these rollers, it is possible to provide a preheating device. As shown in FIGS. 1 and 2, it is possible to provide preheating plate heaters for to guides 31 and 32. Further, as shown in FIG. 3, recording medium R may be preheated by being passed between preheating roller 36, comprising heater 37 in its interior, and the roller which is provided to face said preheating roller 36. As shown in FIGS. 2 and 3, recording medium R, which has been subjected to application of heat and pressure employing pressure applying roller 2 which faces heating roller 1, may be conveyed by belt 4 entrained about these rollers.

The heat and pressure applying method utilizing heating rollers, which is preferably employed in the present invention, is one in which ink jet recording media recorded with a pigment ink are passed between a metallic cylinder having a built-in heating source and a silicone rubber roller.

The heating rollers, which are preferably employed in the present invention, are comprised of a metallic cylinder as well as a silicone rubber roller. Among these, said metallic cylinder may be comprised of common materials such as iron and aluminum, and for the purpose of the enhancing of heat resistance, it may be covered with tetrafluoroethylene, polytetrafluoroethylene-perfluoroalkyl vinyl ether copolymer and the like. Further, in order to enhance the apparent flatness after fixing, it may be subjected to specular treatment. Said metallic cylinder preferably comprises a built-in heating source in its interior, which preferably comprises a linear heater, which preferably heat so that the temperature of the medium becomes at 50 to 150° C., more preferably 80 to 130° C.

In said heating rollers, said metallic cylinder and said silicone rubber roller are arranged to press against each other, and said silicone rubber roller is subjected to deformation so as to form a nip. The width of said nip is generally from 1 to 20 mm, and is preferably from 1.5 to 7 mm.

Said pressure is preferably from 500 to 3,000 N/m in terms of linear pressure. When said linear pressure is less than 500 N/m, there may be a case that pigment ink is not sufficiently included into a thermoplastic resinous particle layer by heating and pressing, while said linear pressure exceeds 3,000 N/m, there may be a case that pigment ink is sufficiently included, but flatness as well as glossiness is degraded.

Listed as silicone emulsions or water-soluble silicone compounds which are preferably added into the coating composition for the thermoplastic resinous particle layer of the present invention are, for example, dimethylsiloxane compounds having a methyl group as a functional group of siloxane, which are commonly known as releasing agents, and compounds in which any of a vinyl group, a hydrogen atom, a mercapto group, a methacrylic group, an amino group, phenyl group, and the like, are substituted to the aforementioned compounds as the substituent.

Further, the content ratio is preferably less than 0.5 to 10 percent in terms of solid by weight with respect to 100 of the thermoplastic resinous particles in terms of releasing properties and color evenness.

The pigment ink of the present invention may be either one which is prepared by dispersing pigments into water, employing either dispersing agents or surface active agents, or another one which comprises as colorants pigments (self-dispersible pigments) having hydrophilic groups which are directly bonded, or bonded via other atom groups, and which can be dispersed into water without employing additional water. However, pigments are preferably dispersed into water employing either dispersing agents or surface active agents. Said dispersing agents are not particularly limited, and it is also possible to employ polymer dispersing agents.

In the water-based ink-jet recording liquid, in addition to the dye of the present invention, water and water-soluble organic solvents are preferably employed in combination.

Examples of water-soluble organic solvents include alcohols (for example, methanol, ethanol, propanol, isopropanol, butanol, isobutanol, s-butanol, tert-butanol, pentanol, hexanol, cyclohexanol, benzyl alcohol, etc.); polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, thiodiglycol, etc.); polyhydric alcohol ethers (for example, ethylene glycol monomethyl ether, ethylene glycol monoethyl ether, ethylene glycol monobutyl ether, diethylene glycol monomethyl ether, diethylene glycol monomethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, ethylene glycol monophenyl ether, propylene glycol monophenyl ether); amines (for example, ethanolamine, diethanolamine, triethanolamine, N-methyldiethanolamine, N-ethyldiethanolamine, morpholine, N-ethylmorpholine, ethylenediamine, diethylenediamine, triethylenetetramine, tetraethylenepentamine, polyethyleneimine, pentamethyldiethyltriamine, tetramethylpropylenediamine, etc.); amides (for example, formamide, N,N-dimethylformamide, N,N-dimethylacetamide, etc.), heterocycles (for example, 2-pyrrolidone, N-methyl-2-pyrrolidone, cyclohexylpyrrolidone, 2-oxazolidone, 1,3-dimethyl-2-imidazolidinone, etc.), sulfoxides (for example, dimethylsulfoxide, etc.); sulfones (for example, sulfolane, etc.); urea, acetonitrile, acetone, etc. Listed as preferred water-soluble organic solvents are polyhydric alcohols. The water-soluble organic solvents may be employed individually or in combination. The added amount in the ink of water-soluble organic solvents is between 5 and 60 weight percent of the total weight, and is preferably between 10 and 30 weight percent.

In order to enhance the dispersion stability of the pigment ink of the present invention, surface active agents are preferably incorporated. Employed as surface active agents, which are preferably incorporated into the pigment ink of the present invention, may be, for example, anionic surface active agents such as dialkylsulfosuccinic acid salts, alkylnaphthalenesulfoninc acid salts, fatty acid salts, and the like; nonionic surface active agents such as polyoxyethylene alkyl ethers, polyoxyethylene alkyl allyl ethers, acetylene glycols, polyoxyethylene-polyoxypropylene block copolymers, and the like; and cationic surface active agents such as alkylamine salts, quarternary ammonium salts; and the like. Specifically, it is possible to preferably employ anionic surface active agents as well as nonionic surface active agents.

Employed as pigment inks of the present invention may be organic and inorganic pigments which are conventionally known in the art. For example, listed are azo pigments such as azo lake, insoluble azo pigment, condensed azo pigment, chelate azo pigment, and the like; polycyclic pigments such as phthalocyanine pigment, perylene pigment, anthraquinone pigment, quinacridone pigment, dioxazine pigment, thioindigo pigment, isoindolinone pigment, quinophthalone pigment, and the like; dye lake such as basic dye type lake, acidic dye type lake, and the like; organic pigments such as nitro pigment, nitroso pigment, aniline black, daylight fluorescent pigment, and the like; and inorganic pigments such as carbon black.

Specific organic pigments are exemplified below.

Listed as pigments for magenta, or red, are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange, or yellow, are C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, and the like.

Listed as pigments for green, or cyan, are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

In order to employ pigments as colorants for use of ink jet recording, it is necessary to realize a high degree of dispersion stability. Further, the demand for the enhancement of clear hues has been actualized. In order to meet these demands, generally, it is necessary to disperse pigment particles at a finer level. However, as the pigment particles are dispersed more finely, cohesive forces increase. As a result, it becomes difficult to maintain dispersion as well as stability. Due to that, for the preparation of said pigment ink, the selection of dispersing agents becomes important to appropriately disperse pigments and to maintain the resultant dispersion.

Preferred as said dispersing agents are polymer dispersing agents. Listed as some of those are, for example, natural polymers including, as specific examples, proteins such as glue, gelatin, casein, albumin, and the like; natural rubbers such as gum Arabic, tragacanth gum, and the like; glucosides such as saponin and the like; alginic acid and derivatives thereof such as alginic acid propylene glycol ester, alginic acid triethanolamine, ammonium alginate, and the like; and cellulose derivatives such as methyl cellulose, carboxymethyl cellulose, hydroxyethyl cellulose, ethyl hydroxycellulose, and the like.

Further, listed as preferred examples of polymer dispersing agents are synthetic polymers, which include polyvinyl alcohols; polyvinylpyrrolidones; acryl based resins such as acrylic acid, acrylic acid-acrylonitrile copolymers, potassium acrylate-acrylonitrile copolymers, vinyl acetate-acrylic acid ester copolymers, acrylic acid-acrylic acid ester copolymers, and the like; styrene-acryl resins such as styrene-acrylic acid copolymers, styrene-methacrylic acid copolymers, styrene-methacrylic acid-acrylic acid ester copolymers, styrene-α-methylstyrene-acrylic acid copolymers, styrene-α-methylstyrene-acrylic acid-acrylic acid ester copolymers, and the like; styrene-maleic acid copolymers, styrene-maleic anhydride copolymers, vinylnaphthalene-acrylic acid copolymers, vinylnaphthalene-maleic acid copolymers; vinyl acetate based copolymers such as vinyl acetate-ethylene copolymers, vinyl acetate-fatty acid vinylethylene copolymers, vinyl acetate-maleic acid ester copolymers, vinyl acetate-crotonic acid copolymers, vinyl acetate-acrylic acid copolymers, and the like; and salts thereof. Of these, specifically preferred are styrene-acryl resins such as styrene-acrylic acid copolymers, styrene-methacrylic acid copolymers, styrene-methacrylic acid-acrylic acid ester copolymers, styrene-α-methylstyrene-acrylic acid copolymers, and styrene-α-methylstyrene-acrylic acid-acrylic acid ester copolymers, and salts thereof. Of these, specifically preferred are copolymers of monomers having a hydrophobic group with monomers having a hydrophilic group and polymers of monomers having a hydrophobic group as well as a hydrophilic group in their molecular structure. The weight average molecular weight of these copolymers is preferably from 3,000 to 30,000, and is more preferably from 5,000 to 15,000.

The addition amount of dispersing agents is preferably from about 5 to about 60 percent by weight with respect to the total weight of pigments in the ink composition, and is more preferably from about 20 to 50 percent by weight.

Incidentally, it is possible to employ low molecular weight dispersing agents other than these polymer dispersing agents. However, when an ink jet recording material, which comprises a support having thereon layers comprising an ink receiving layer comprising thermoplastic resinous particles, is recorded employing a pigment ink, the material comprising said polymers preferably exhibits excellent water resistance after recording.

Employed as pigment ink dispersion methods may be any type such as a ball mill, a sand mill, an atriter, a roll mill, an agitator, a Henschel mixer, a colloid mill, an ultrasonic homogenizer, a pearl mill, a wet type jet mill, a paint shaker, and the like.

For the purpose of removing coarse particle components of the pigment ink dispersion of the present invention, centrifugal apparatus, as well as filters, are preferably employed.

The average particle diameter of the pigment dispersion employed in the present invention is preferably from 10 to 200 nm, is more preferably from 30 to 150 nm, and is further more preferably from 50 to 120 nm. When the average diameter of said pigment dispersion exceeds 200 nm, the glossiness of images recorded on glossy media tends to be degraded, and the transparency of images recorded on transparent media is markedly degraded. Further, when the average particle diameter of said pigment dispersion is less than 10 nm, the stability of said pigment dispersion tends to become unstable and the storage stability of ink tends to degrade.

It is possible to determine the particle diameter of said pigment ink dispersion, employing commercially available particle diameter measurement apparatus utilizing a light scattering method, an electrophoretic method, a laser Doppler method, and the like. Further, it is also possible to obtain said particle diameter in such a manner that at least 100 particles are imaged employing a transmission type electron microscope, and the resultant image is subjected to statistic treatment utilizing an image analysis software such as Image-Pro (manufactured by Media Cybernetics).

The pigment ink of the present invention may comprise latexes. The latexes as described herein refer to polymer particles in a dispersion state in a media. Listed as examples of polymer types are, for example, styrene-butadiene copolymers, polystyrene, acrylonitrile-butadiene copolymers, polyacrylic acid esters, polyurethane, silicone-acryl copolymers, acryl modified fluorine resins, and the like. Of these, polyacrylic acid esters, polyurethane, and silicone-acryl copolymers are preferred.

Generally employed as emulsifying agents, which are used to produce said latexes, are low molecular weight surface active agents. However, in some case, high molecular weight surface active agents (for instance, a type in which a solubilizing group is subjected to graft bonding with polymer, and a block polymer type prepared by bonding a part having a solubilizing group with an insoluble part, and the like) are employed as the emulsifying agent. Further, there are latexes which are dispersed without employing an emulsifying agent by bonding a solubilizing group directly with the center polymer of latexes. Said latexes which are prepared by using high molecular weight surface active agents as the emulsifying agent as well as latexes which are prepared without employing emulsifying agents are called soap free latexes. Irrespective of types and forms, soap free latexes are more preferably employed as the emulsifying agents of the present invention.

Further, recently, other than latexes having uniform polymer at the central portion, there are core-shell type latexes having different compositions between the central portion and the peripheral portion, which may be preferably employed.

The average particle diameter of latexes, which are preferably employed in the present invention, is preferably 10 to 150 nm, and is more preferably 20 to 50 nm.

It is possible to simply and readily determine the average particle diameter of latexes employing commercially available measurement apparatus utilizing a light scattering method, and a laser Doppler method.

The content ratio of latex solids is from 0.1 to 10 percent by weight with respect to the total weight of pigment ink, and is preferably from 0.3 to 5 percent by weight.

When the content ratio is less than 0.1 percent by weight, it is difficult to achieve sufficient effects regarding water resistance. By contrast, when the content ratio exceeds 10 percent by weight, problems with the retention quality of the pigment ink occur in which the viscosity tends to increases over an elapse of time, and the dispersed particle diameter of pigment ink tends to increase.

In the present invention, it is possible to employ electrical conductivity regulating agents which include, for example, inorganic salts such as potassium chloride, ammonium chloride, sodium sulfate, sodium nitrate, sodium chloride, and the like, water-miscible amines such as triethanolamine, and the like.

Other than these, if desired, antiseptics, mildewcides, and viscosity regulating agents may also be incorporated into the pigment ink of the present invention.

Employed as ink jet heads, which are employed in the image forming method of the present invention, may be either an on-demand type or a continuous type. Further, listed as specific examples of ejection systems may be an electrical-mechanical conversion system (for example, a single cavity type, a double cavity type, a bender type, a piston type, a share-mode type, a shared wall type, and the like), an electrostatic attraction system (for example, an electric field controlling type, a slit jet type, and the like), and a discharge system (for example, spark jet type, and the like). Any of these ejection systems may be employed.

EXAMPLES

The present invention is specifically described with reference to the examples. However, the present invention is not limited to these embodiments.

Incidentally, "%" in the examples is % by weight, unless otherwise specified.

Example 1

(Preparation of Recording Medium A)

<Preparation of Titanium Oxide Dispersion-1>

Added to 90 liters of an aqueous solution containing 150 g of sodium tripoliphosphoric acid having a pH of 7.5, 500 g of polyvinyl alcohol (PVA 235 having an average degree of polymerization of 3,500, manufactured by Kuraray Co., Ltd.), 150 g of cationic polymer, P-1, and 10 g of silicon emulsion antifoaming agent, SN 381 of Sun Nobuko Co., Ltd., were 20 kg of titanium dioxide (W-10, Shihara Sangyo) having an average diameter of 0.25 μm. The resultant mixture was dispersed employing a high pressure homogenizer (manufactured by Sanwa Kogyo Co., Ltd.). Subsequently, the total volume was adjusted to 100 liters, whereby uniformly dispersed Titanium Oxide Dispersion-1 was obtained.

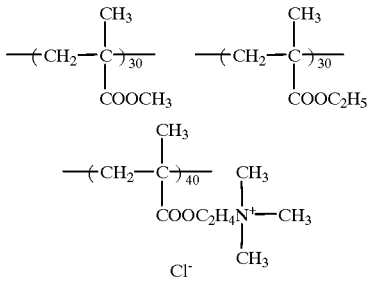

Mn = 13,000

<Preparation of Silica Dispersion-1>

Suction dispersed into 620 liters of pure water, in which the pH was adjusted to 2.5 using nitric acid, were 125 kg of gas phase method silica (A300, Nippon Aerosil Kogyo Co., Ltd.) having a primary particle diameter of 0.007 μm, employing a Jet Stream Inductor Mixer TDS manufactured by Mitamura Riken Kogyo Co., Ltd. Thereafter, the total volume was adjusted to 694 liters, employing pure water. Particles in the diluted dispersion were subjected to image capturing employing an electron microscope. It was confirmed that most particles had an average particle diameter of no more than 0.01 μm and were dispersed in the form of the primary particles (most particles refers to those in a ratio of 85 to 90 percent).

<Preparation of Silica Dispersion-2>

While stirring, added to 18 liters of a solution (maintained at a pH of 2.3) containing 1.41 kg of cationic polymer, P-2, and 4.2 liters of ethanol were 69.4 liters of Silica Dispersion-1 in a temperature range of from 25 to 30° C. over 20 minutes. Subsequently, 7.0 liters of an aqueous solution (at a pH of 2.3) containing 260 g of boric acid and 230 g of borax were added while stirring to the resulting mixture over 10 minutes. The resulting mixture was subjected to double dispersion under a pressure of 24.5 MPa, employing a high pressure homogenizer manufactured by Sanwa Kogyo Co., Ltd. The total volume of the resulting dispersion was adjusted to 97 liters, whereby nearly transparent Silica Dispersion-2 was prepared.

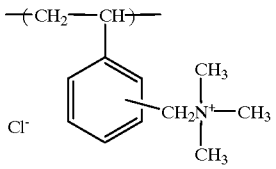

Mn = 24,000

<Preparation of Optical Brightening Agent Dispersion-1>

Dissolved in a mixture of 9,000 g of diisodecyl phthalate and 12 liters of ethyl acetate, while being heated, were 400 g of oil-soluble optical brightening agent UIVITEX-OB, manufactured by Ciba-Geigy Corporation, Ltd. The resulting solution was mixed with 65 liters of an aqueous solution comprising 3,500 g of acid processed gelatin, a cationic polymer, P-2, and 6,000 ml of 50% aqueous saponin solution, and the resulting mixture was emulsify-dispersed three times under a pressure of 24.5 MPa (250 kgf/cm$^2$), employing a high pressure homogenizer, manufactured by Sanwa Kogyo Co., Ltd. Subsequently, the resulting dispersion was subjected to removal of its ethyl acetate under reduced pressure, and the total volume was then adjusted to 100 liters. The pH of the resulting dispersion was approximately 5.3.

<Preparation of Coating Compositions>

A first layer, a second layer, and a third layer were prepared employing the procedures described below.

First Layer Coating Composition

While stirring, additives described below were successively mixed with 600 ml of Silica Dispersion-1 at 40° C.

| | |
|---|---|
| 7% aqueous polyvinyl alcohol (PVA 235 having an average degree of polymerization of 3,500, manufactured by Kuraray Kogyo Co., Ltd.) solution | 194.6 ml |
| Optical Brightening Agent Dispersion-1 | 25 ml |
| Titanium Oxide Dispersion-1 | 33 ml |
| Latex Emulsion AE-803, manufactured by Daiichi Kogyo Co., Ltd.) | 18 ml |
| Pure water to make | 1000 ml |

The pH of the resulting coating composition was 4.4.

Second Layer Coating Composition

While stirring, the additives described below were successively mixed with 650 ml of Silica Dispersion-2 at 40° C.

| | |
|---|---|
| 7% polyvinyl alcohol (PVA 235 having an average degree of polymerization of 3,500, manufactured by Kuraray Kogyo Co., Ltd.) solution | 201.6 ml |
| Optical Brightening Agent Dispersion-1 | 35 ml |
| Pure water to make | 1000 ml |

The pH of the resulting coating composition was 4.4.

Third Layer Coating Composition

While stirring, the additives described below were successively mixed with 650 ml of Silica Dispersion-2 at 40° C.

| | |
|---|---|
| 7% aqueous polyvinyl alcohol (PVA 235 having an average degree of polymerization of 3,500, manufactured by Kuraray Kogyo Co., Ltd.) | 201.6 ml |
| Silicone dispersion (BY-22-839, manufactured by Toray-Dow Corning-Silicone Co., Ltd.) | 15 ml |
| 50% aqueous saponin solution | 4 ml |
| Pure water to make | 1000 ml |

The pH of the resulting coating composition was 4.5.

Coating compositions prepared as previously described were filtered employing the filter described below.

First layer and second layer: 2-stage filtration employing TCP 10 manufactured by Toyo Roshi Co., Ltd. Third layer: 2-stage filtration employing TCP 30 manufactured by Toyo Roshi Co., Ltd.

Subsequently, each layer was applied onto a paper support (having a thickness of 220 μm, and a polyethylene layer on the ink absorbing side comprising 13% by weight of anatase type titanium oxide with respect to the polyethylene) laminated with polyethylene on both sides in the order of the first layer (50 μm), the second layer (100 μm), and the third layer (50 μm). The figures in parenthesis are wet thickness. The first, second, and third layers were simultaneously coated.

During coating, each coating composition was maintained at 40° C., and a 3-layer type slide hopper was employed. Immediately after coating, the resulting coat was cooled for 20 seconds in a cooling zone, maintained at 0° C. Thereafter, the cooled coat was successively dried under a 25° C. air flow (at a relative humidity of 15%) for 60 seconds, a 45° C. air flow (at a relative humidity of 25%) for 60 seconds, and a 50° C. air flow (at a relative humidity of 25%) for 60 seconds, and was then subjected to moisture content control under an atmosphere of 20 to 25° C. and 40 to 60% relative humidity for 2 minutes. The resulting sample was then wound whereby a recording medium comprised of only a solvent absorptive layer was obtained.

Subsequently, a thermoplastic resinous layer coating composition was prepared employing the formula described below.

| | |
|---|---|
| AT-2000 (styrene-acrylic acid copolymer latex having a Tg of 80° C. and an MFT of 85° C., manufactured by Showa Kobunshi Co.) | 50% |
| AS-7180 (acryl based copolymer sodium salt, manufactured by Toa Gosei Kagaku Co., Ltd.) | 3% |
| Water | 47% |

Employing a wire bar, the thermoplastic resinous layer coating composition was applied onto said recording medium comprised of only a solvent absorptive layer to obtain a dried layer thickness of 5 μm. Subsequently, the resulting coat was dried at 50° C. for 30 minutes, whereby Recording Medium A was prepared.

| | |
|---|---|
| C.I. Pigment Yellow 74 | 20% by weight |
| Styrene-acrylic acid copolymer (having a molecular weight of 10,000, and acid number of 120) | 12% by weight |
| Diethylene glycol | 15% by weight |
| Deionized water | 53% by weight |

After mixing said components, the resulting mixture was dispersed employing a lateral type bead mill (System Zeta Mini, manufactured by Ashizawa Co.) filled with 0.3 mm zirconia beads at an volume ratio of 60 percent, whereby Yellow Pigment Dispersion 1 was prepared. The average particle diameter of the obtained yellow pigment particles was 112 nm.

(Preparation of Magenta Dispersion 1)

| | |
|---|---|
| C.I. Pigment Red 122 | 25% by weight |
| Johncryl 61 (acryl-styrene based resin, manufactured by Johnson Co.) (solids) | 18% by weight |
| Diethylene glycol | 15% by weight |
| Deionized water | 42% by weight |

After mixing said components, the resulting mixture was dispersed employing a lateral type bead mill (System Zeta Mini, manufactured by Ashizawa Co.) filled with 0.3 mm zirconia beads at an volume ratio of 60 percent, whereby Magenta Pigment Dispersion 1 was prepared. The average particle diameter of the obtained magenta pigment particles was 105 nm.

(Preparation of Cyan Dispersion 1)

| | |
|---|---|
| C.I. Pigment Blue 15:3 | 25% by weight |
| Johncryl 61 (acryl-styrene based resin, manufactured by Johnson Co.) (solids) | 15% by weight |
| Glycerin | 10% by weight |
| Deionized water | 50% by weight |

After mixing said components, the resulting mixture was dispersed employing a lateral type bead mill (System Zeta Mini, manufactured by Ashizawa Co.) filled with 0.3 mm zirconia beads at an volume ratio of 60 percent, whereby Cyan Pigment Dispersion 1 was prepared. The average particle diameter of the obtained magenta pigment particles was 87 nm.

(Preparation of Black Dispersion 1)

| | |
|---|---|
| Carbon black | 20% by weight |
| Styrene-acrylic acid copolymer (having a molecular weight of 7,000 and a acid number of 150) | 10% by weight |
| Glycerin | 10% by weight |
| Deionized water | 60% by weight |

After mixing said components, the resulting mixture was dispersed employing a lateral type bead mill (System Zeta Mini, manufactured by Ashizawa Co.) filled with 0.3 mm zirconia beads at an volume ratio of 60 percent, whereby Black Pigment Dispersion 1 was prepared. The average particle diameter of the obtained magenta pigment particles was 75 nm.

(Preparation of Pigment Ink)

(Preparation of Dense Yellow Ink 1)

| | |
|---|---|
| Yellow Dispersion 1 | 15% by weight |
| Acryl emulsion (Yodozoru AD53 having a Tg of 80° C. and an average particle diameter of 80 nm, manufactured by Nippon NCS Co.) | 10% by weight |
| Ethylene glycol | 20% by weight |
| Diethylene glycol | 10% by weight |
| Maltitol | 10% by weight |
| Surface active agent (Surfinol 465, manufactured by Nisshin Kagaku Kogyo Co.) | 0.1% by weight |
| Deionized water | 39.9% by weight |

After mixing said components while stirring, the resulting mixture was filtered employing a 1 μm filter, whereby Dense Yellow Ink 1 was prepared. The average particle diameter of pigment particles contained said ink was 120 nm, and its surface tension γ was 36 mN/m.

(Preparation of Pale Yellow Ink 1)

| | |
|---|---|
| Yellow Dispersion 1 | 3% by weight |
| Acryl emulsion (Yodozoru AD53 having a Tg of 80° C. and an average particle diameter of 80 nm, manufactured by Nippon NCS Co.) | 10% by weight |
| Ethylene glycol | 25% by weight |

-continued

| | |
|---|---|
| Diethylene glycol | 10% by weight |
| Maltitol | 10% by weight |
| Surface active agent (Surfinol 465, manufactured by Nisshin Kagaku Kogyo Co.) | 0.1% by weight |
| Deionized water | 41.9% by weight |

After mixing said components while stirring, the resulting mixture was filtered employing a 1 μm filter, whereby Pale Yellow Ink 1 was prepared. The average particle diameter of pigment particles contained said ink was 118 nm, and its surface tension γ was 37 mN/m.

(Preparation of Dense Magenta Ink 1)

| | |
|---|---|
| Magenta Dispersion 1 | 15% by weight |
| Styrene-acryl emulsion (Microjel E-1002 having a Tg of about 60° C. and an average particle diameter of 100 nm, manufactured by Nippon Paint Co.) | 10% by weight |
| Ethylene glycol | 20% by weight |
| Diethylene glycol | 10% by weight |
| Maltitol | 5% by weight |
| Surface active agent (Surfinol 465, manufactured by Nisshin Kagaku Kogyo Co.) | 0.1% by weight |
| Deionized water | 39.9% by weight |

After mixing said components with stirring, the resulting mixture was filtered employing a 1 μm filter, whereby Dense Magenta Ink 1 was prepared. The average particle diameter of pigment particles contained said ink was 113 nm, and its surface tension γ was 35 mN/m.

(Preparation of Pale Magenta Ink 1)

| | |
|---|---|
| Magenta Dispersion 1 | 3% by weight |
| Acryl emulsion (Microjel E-1002 having a Tg of about 60° C. and an average particle diameter of 100 nm, manufactured by Nippon Paint Co.) | 8% by weight |
| Ethylene glycol | 25% by weight |
| Diethylene glycol | 10% by weight |
| Maltitol | 10% by weight |
| Surface active agent (Surfinol 465, manufactured by Nisshin Kagaku Kogyo Co.) | 0.1% by weight |
| Deionized water | 43.9% by weight |

After mixing said components while stirring, the resulting mixture was filtered employing a 1 μm filter, whereby Pale Magenta Ink 1 was prepared. The average particle diameter of pigment particles contained said ink was 110 nm, and its surface tension γ was 37 mN/m.

(Preparation of Dense Cyan Ink 1)

| | |
|---|---|
| Cyan Dispersion 1 | 10% by weight |
| Styrene-acryl emulsion (Yodozoru GD86B having a TG of 60° C. and an average particle diamter of 90 nm, manufactured by Nippon NCS Co.) | 10% by weight |
| Ethylene glycol | 20% by weight |
| Diethylene glycol | 10% by weight |
| Maltitol | 5% by weight |

-continued

| | |
|---|---|
| Surface active agent (Surfinol 465, manufactured by Nisshin Kagaku Kogyo Co.) | 0.1% by weight |
| Deionized water | 44.9% by weight |

After mixing said components while stirring, the resulting mixture was filtered employing a 1 μm filter, whereby Dense Cyan Ink 1 was prepared. The average particle diameter of pigment particles contained said ink was 95 nm, and its surface tension γ was 36 mN/m.

(Preparation of Pale Cyan Ink 1)

| | |
|---|---|
| Cyan Dispersion 1 | 2% by weight |
| Acryl emulsion (Yodozoru GD86B having a Tg of 60° C. and an average particle diameter of 90 nm, manufactured by Nippon NCS Co.) | 10% by weight |
| Ethylene glycol | 25% by weight |
| Diethylene glycol | 10% by weight |
| Maltitol | 10% by weight |
| Surface active agent (Surfinol 465, manufactured by Nisshin Kagaku Kogyo Co.) | 0.2% by weight |
| Deionized water | 42.8% by water |

After mixing said components while stirring, the resulting mixture was filtered employing a 1 μm filter, whereby Pale Cyan Ink 1 was prepared. The average particle diameter of pigment particles contained said ink was 92 nm, and its surface tension γ was 33 mN/m.

(Preparation of Dense Black Ink 1)

| | |
|---|---|
| Black Dispersion 1 | 10% by weight |
| Acryl emulsion (Yodozoru GD86B having a Tg of 60° C. and an average particle diameter of 90 nm, manufactured by Nippon NCS Co.) | 8% by weight |
| Ethylene glycol | 20% by weight |
| Diethylene glycol | 10% by weight |
| Maltitol | 5% by weight |
| Surface active agent (Surfinol 465, manufactured by Nisshin Kagaku Kogyo Co.) | 0.1% by weight |
| Deionized water | 46.9% by weight |

After mixing said components while stirring, the resulting mixture was filtered employing a 1 μm filter, whereby Dense Black Ink 1 was prepared. The average particle diameter of pigment particles contained said ink was 85 nm, and its surface tension γ was 35 mN/m.

(Preparation of Pale Black Ink 1)

| | |
|---|---|
| Black Dispersion 1 | 2% by weight |
| Acryl emulsion (Yodozoru GD86B having a Tg of 60° C. and an average particle diameter of 90 nm, manufactured by Nippon NCS Co.) | 8% by weight |
| Ethylene glycol | 25% by weight |
| Diethylene glycol | 10% by weight |
| Maltitol | 10% by weight |

-continued

| | |
|---|---|
| Surface active agent (Surfinol 465, manufactured by Nisshin Kagaku Kogyo Co.) | 0.1% by weight |
| Deionized water | 44.9% by weight |

After mixing said components while stirring, the resulting mixture was filtered employing a 1 μm filter, whereby Pale Black Ink 1 was prepared. The average particle diameter of pigment particles contained said ink was 89 nm, and its surface tension γ was 36 mN/m.

(Recording onto Recording Medium A)

While utilizing the aforementioned pigment inks, each having yellow, magenta, cyan, and black image patterns, which resulted in a reflection density of 1.0, were prepared employing an on-demand type ink jet printer having a maximum recording density of 720×720 dpi (dpi as described herein refers to the number of dots per 2.54 cm). Said ink jet printer was equipped with a piezo type head having a nozzle particle diameter of 20 μm, a driving frequency of 12 kHz, 128 nozzles per color, and a nozzle density for the same color of 180 dpi (dpi as described herein refers to the number of dots per 2.54 cm).

Print samples were dried at 120° C. for 20 minutes 10 minutes after the image formation. The resulting sample was designated as Sample 101.

Subsequently, a fixing unit comprised of a 30 mmϕ column-shaped iron cylinder (being an upper roller) and a silicone rubber roller (a lower roller with 30 mmϕ diameter) was adjusted to result in a linear pressure of 2000 N/m and a nip width of 4.3 mm. Sample 101 was conveyed through said fixing unit at a linear speed of 10 mm/second whereby Sample 102 was prepared.

Subsequently, Sample 103 was prepared employing the different fixing unit from sample 102, featuring a built-in heater in the iron cylinder, which was comprised of an upper roller and a lower roller, both of which were covered with tetrafluoroethylene-perfluoroalkyl ether copolymer. When fixed, the surface temperature of the rollers was adjusted to 120° C.

Sample 104 was prepared in the same manner as Sample 103, except that the surface temperature of the rollers was 170° C.

Sample 105 was prepared in the same manner as Sample 104, except that an ink jet recording medium was prepared, in which, during the preparation of said ink jet recording medium, an aqueous dispersion of dimethylpolysiloxane was added into the thermoplastic resinous particle layer so as to result in an weight ratio of 5 percent, with respect to styrene-acrylic acid copolymer latex in terms of solid component.

Samples 101 through 105, prepared as previously described, were subjected to evaluation of abrasion resistance as well as releasability employing the methods described below.

(Evaluation of Abrasion Resistance)

Fixed Samples were rubbed 5 times employing a plastic eraser, and the degree of decrease in density was graded based on the criteria described below.

A: no decrease in density was noted

B: a slight decrease in density was noted, but no image degradation was noticed

C: a decrease in density was noted, and image quality was degraded

D: marked decrease in density was noted, which resulted in highly adverse effects to image quality (Evaluation of Releasability)

Prepared were thirty sheets of each of Samples 101 through 105, which were not fixed after printing, and were fixed at each condition mentioned above. The evaluation was based on the criteria described below.

A: no sheets resulted in adhering to the roll

B: 1 or 2 sheets resulted in adhering to the roll

C: 3 or 4 sheets resulted in adhering to the roll

D: at least 5 sheets resulted in adhering to the roll

The evaluation results are summarized in Table 1.

TABLE 1

| Sample No. | Releasability | Abrasion Resistance | Remarks |
|---|---|---|---|
| 101 | - (*) | C | Comparative |
| 102 | C | D | Comparative |
| 103 | B | A | Present Invention |
| 104 | C | A | Present Invention |
| 105 | A | A | Present Invention |

(*) Sample 1 eas not subjected to heat roller through test and releasability was not estimated.

As can clearly be seen from the results in Table 1, Sample 101, which was subjected to only heating without pressing, resulted in degradation of abrasion resistance, supposedly due to insufficient inclusion of pigment particles in the thermoplastic resins layer, and further in insufficient releasability.

On the other hand, Sample 102, in which image fixing had been carried out by pressure, resulted in marked degradation of abrasion resistance compared to Sample 101. These results indicate that melting the thermoplastic resin by heating as well as movement of pigment particles is necessary for enhancing the abrasion resistance.

Contrary to this, it was found that Sample 103, in which heating as well as pressing was optimized, exhibited good abrasion resistance and also resulted in no problems with releasability.

Sample 104, in which the fixing temperature was further increased compared to Sample 103, adhered to the fixing roller.

Contrary to this, it was found that Sample 105, in which a silicone emulsion was incorporated into the thermoplastic resinous layer, exhibited excellent abrasion resistance as well as excellent releasability.

Example 2

<Preparation of Recording Medium B>

An ink absorptive solvent coating composition comprised of a polyurethane resin (water soluble urethane resin Paterakoru IJ-40, manufactured by Dainippon Ink Co.) as the primary component, employing a wire bar, was applied onto a paper support laminated with 220 μm thick polyethylene to obtain a dried layer thickness of 30 μm, and subsequently dried at 70° C. for 20 minutes. Ink Jet Recording Medium B was prepared by applying the coating composition comprising the same thermoplastic resnous layer as Example 1 onto the resulting coating to obtain a dried layer thickness of 5 μm.

By employing the same pigment ink, as well as the same recording apparatus, as Example 1, image patterns resulting in reflection density of 1.0 were prepared for each of yellow, magenta, cyan, and black.

These samples, prepared as above, were subjected to the same fixing methods as Samples 101 through 103 to prepare Samples 201 through 203. Sample 204 was prepared in the same manner as Sample 103, except that the linear pressure during fixing was varied to 500 N/m.

Subsequently, Sample 205 was prepared in the same manner as Sample 203, except that a self-diffusible black ink prepared, employing the method described below, was employed (Preparation of Self-diffusible Carbon Black Pigment Ink)

Charged into a 4-necked flask, fitted with a reflux cooling unit and a glass stirring blade, were 20 g of carbon black (Printex #75, manufactured by Degussa Co.) and 80 g of concentrated sulfuric acid. The resulting mixture underwent oxidation while being refluxed in an oil bath at 120° C. for 10 hours. The reaction product was then subjected to cooling, centrifugal separation, and decantation. After no more precipitation was formed after said centrifugal separation, the resulting product was subjected to ultrafiltration, and the pigment concentration was adjusted by deionized water, whereby a self-diffusible pigment at a concentration of 20 percent was obtained. Further, pigment ink was prepared employing the formulas described below.

Pigment ink dispersion 20 g

Glycerin 20 g

Diethylene glycol monobutyl ether 5 g

Purokiseru GXL 0.01 g

The total volume of the above mixture was adjusted to 100 g employing deionized water, and the resulting mixture was filtered twice employing a 0.45 μm membrane filter, whereby a pigment ink was prepared.

Samples 201 through 205, prepared as above, were subjected to evaluation of abrasion resistance as well as glossiness.

Abrasion resistance was evaluated in the same manner as Example 1.

The degree of relative glossiness with respect to that prior to fixing was evaluated as described below. Incidentally, Sample 205 was printed employing the self-diffusible carbon black pigment and was subjected to the evaluation described below while only noting the black.

A: glossiness was markedly enhanced due to fixing

B: glossiness was fairly enhanced due to fixing

C: glassiness was slightly enhanced due to fixing

D: glossiness was lowered due to fixing

These evaluation results are summarized in Table 2.

TABLE 2

| Sample No. | Glossiness | Abrasion Resistance | Remarks |
|---|---|---|---|
| 201 | D | C | Comparative |
| 202 | D | D | Comparative |
| 203 | A | A | Present Invention |
| 204 | B | B | Present Invention |
| 205 | C | B | Present Invention |

As can clearly be seen from Table 2, Sample 201 exhibited poor abrasion resistance as well as poor glossiness due to the insufficient smoothness enhancing effect of the image surface without an application of pressure.

Sample 202 was only subjected to application of pressure without application of heat. As a result, Sample 202 exhibited glossiness inferior to Sample 201. Sample 203, which was optimally subjected to application of heat as well as application of pressure, resulted in satisfactory results regarding abrasion resistance as well as glossiness. Sample 204 resulted in enhanced effects of abrasion resistance, but in insufficient glossiness.

On the other hand, Sample 205, in which the self-diffusible pigment was used for black, resulted in decrease in glossiness as well as in abrasion resistance, and further results in a decrease in density.

Example 3

Samples 301 through 307 were prepared in the same manner as Sample 103 of Example 1, except that the nip width, solvent reaching temperature, and linear pressure were varied as shown in Table 3. Thereafter each sample was evaluated as to glossiness and abration resistance in the same manner as Example 2.

TABLE 3

| Sample No. | Nip Width (mm) | Linear Pressure (N/m) | Solvent Reaching Temperature (° C.) | Glossiness | Abrasion Resistance |
|---|---|---|---|---|---|
| 301 | 0.5 | 2000 | 50 | C | B |
| 302 | 5.0 | 300 | 110 | C | B |
| 303 | 5.0 | 2000 | 110 | A | A |
| 304 | 7.0 | 2500 | 120 | A | A |
| 305 | 25.0 | 2000 | 110 | C | A |
| 306 | 5.0 | 3500 | 110 | C | A |
| 307 | 5.0 | 2000 | 160 | C | A |

Example 4

Samples 401 through 405 were prepared in the same manner as Sample 105 of Example 1, except that the solid content of dimethylpolysiloxane was varied as shown in Table 4.

Incidentally, the releasability was more severely evaluated, by increasing the number of sheets to 200 for each.

(Evaluation of Color Mottle)

After printing, 200 unfixed sheets were prepared for each of Samples 401 through 405. Subsequently, fixing was carried out under each of the conditions previously described, and releasability and color mottle were evaluated based on the criteria described below.

A: color mottle was not noticed

B: slight color mottle was noticed, but images were acceptable

C: definite color mottle was noticed and the image quality was degraded

D: marked color mottle was noticed, which adversely affected image quality.

The releasability was evaluated in the same manner as Example 1.

TABLE 4

| Sample No. | Solid Content of Dimethylpolysiloxane | Releasability | Color Mottle |
|---|---|---|---|
| 401 | 0.1% | D | A |
| 402 | 0.5% | B | A |
| 403 | 5.0% | A | A |
| 404 | 10.0% | A | B |
| 405 | 15.0% | A | D |

As proved in the examples, the image forming method according to the present invention resulted in excellent effects in glossiness, abrasion resistance, and releasability, when ink jet recording was carried out employing pigment inks.

What is claimed is:

1. An image forming method comprising:

jetting a pigment ink having a pigment dispersion onto an ink jet recording medium by means of an ink jet method, wherein said ink jet recording medium comprises a support, and provided thereon, an ink receptive layer comprising thermoplastic resinous particles farthest from the support and said pigment dispersion has an average particle diameter within the range of 30 to 150 nm; and thereafter applying heat and pressure simultaneously to the ink jet recording medium having the jetted ink wherein the combination of the heat and pressure with the required particle diameter range produces improved glossiness while maintaining good light fastness.

2. The image forming method of claim 1 wherein the ink jet recording medium comprises a pigment ink solvent absorptive layer adjacent to said ink receptive layer.

3. The image forming method of claim 2 wherein the pigment ink comprises a dispersing agent and a solvent.

4. The image forming method of claim 2 wherein the void volume of the ink receiving layer and the pigment ink solvent-absorbing layer is from 20 to 40 ml/m$^2$.

5. The image forming method of claim 1, wherein the heat and pressure are applied employing a heating roller.

6. The image forming method of claim 5, wherein the heat and pressure are applied employing heating roller comprising a metallic cylinder and a silicone rubber roller.

7. The image forming method of claim 6, wherein the metallic cylinder contains a heating source inside of the metallic cylinder.

8. The image forming method of claim 6, wherein a nip width, formed by pressure between said metallic cylinder and said silicone rubber roller, is from 1 to 20 mm.

9. The image forming method of claim 8 wherein the linear pressure resulted by said heating roller is from 500 to 3,000 N/m.

10. The image forming method of claim 9, wherein the heating temperature of the ink jet recording medium is from 50 to 150° C.

11. The image forming method of claim 5 wherein the glass transition point, Tg, of said thermoplastic resinous layer is higher than temperature at which said thermoplastic resinous particles are coated and dried during the production of said ink jet recording material, and is lower than the temperature at which said support is subjected to thermal modification due to said heating.

12. The image forming method of claim 11 wherein the void volume of the ink receiving layer and the pigment ink solvent-absorbing layer is from 20 to 40 ml/m$^2$.

13. The image forming method of claim 1, wherein the heating temperature of the ink jet recording medium is from 50 to 150° C.

14. The image forming method of claim 1 wherein the heat and pressure are applied employing a heating roller, and the linear pressure resulted by said heating roller is from 500 to 3,000 N/m.

15. The image forming method of claim 1, wherein the thermoplastic resinous layer comprises a silicone emulsion in an amount of 0.5 to 10 percent by weight in terms of solid, or a water-soluble silicone compound in an amount of 0.5 to 10 percent by weight, with respect to the thermoplastic resinous particles.

16. The image forming method of claim 15 wherein the void volume of the ink receiving layer and the pigment ink solvent-absorbing layer is from 20 to 40 ml/m$^2$.

17. The image forming method of claim 16, wherein the heat and pressure is applied employing a heating roller and a silicon rubber roller, a nip width, formed by pressure between said metallic cylinder and said silicone rubber roller, is from 1 to 20 mm, the heating temperature of the ink jet recording medium is from 50 to 150° C., and the linear pressure resulted by said heating roller is from 500 to 3,000 N/m.

18. The image forming method of claim 1, wherein at least one of the pigment ink comprises latex.

19. The image forming method of claim 18, wherein the latex is selected from the group consisting of styrenebutadiene copolymer, polystyrene, acrylonitrile-butadiene copolymer, polyacrylic acid ester, polyurethane, silicone-acryl copolymer and acryl modified fluorine resin.

20. The image forming method of claim 19, wherein the latex is polyacrylic acid esters, polyurethane or silicone-acryl copolymer.

21. The image forming method of claim 18, wherein the latex has an average particle diameter of 10 to 150.

22. The image forming method of claim 18, wherein the solid content ratio of the latex is from 0.1 to 10 percent by weight with respect to the total weight of the pigment ink.

23. An image forming method comprising:

jetting a pigment ink onto an ink jet recording medium comprising a support, and provided thereon, an ink jet receptive layer comprising thermoplastic resinous particles farthest from the support, by means of an ink jet method; and applying heat and pressure simultaneously to the ink jet recording medium having the jetted ink, wherein the glass transition point, Tg, of said thermoplastic resinous particles is higher than the temperature at which said thermoplastic resinous particles are coated and dried during the production of said ink jet recording material, and is lower than the temperature at which said support is subjected to thermal modification due to said heating.

* * * * *